US009272716B2

(12) United States Patent
LeDee

(10) Patent No.: US 9,272,716 B2
(45) Date of Patent: Mar. 1, 2016

(54) ANTI-THEFT DEVICE FOR A LOCOMOTIVE HORN

(71) Applicant: UNION PACIFIC RAILROAD COMPANY, Omaha, NE (US)

(72) Inventor: Moses LeDee, Ville Platte, LA (US)

(73) Assignee: UNION PACIFIC RAILROAD COMPANY, Omaha, NE (US)

( * ) Notice: Subject to any disclaimer, the term of this patent is extended or adjusted under 35 U.S.C. 154(b) by 320 days.

(21) Appl. No.: 13/918,182

(22) Filed: Jun. 14, 2013

(65) Prior Publication Data

US 2014/0366769 A1 Dec. 18, 2014

(51) Int. Cl.

| | |
|---|---|
| ***E05B 65/00*** | (2006.01) |
| ***B61C 17/00*** | (2006.01) |
| ***B61K 13/00*** | (2006.01) |

(52) U.S. Cl.

CPC ..... *B61C 17/00* (2013.01); *B61K 13/00* (2013.01); *E05B 65/00* (2013.01); *Y10T 70/491* (2015.04)

(58) Field of Classification Search

CPC ..... Y10T 70/5867; Y10T 70/5009; Y10T 70/5991; Y10T 70/5031; Y10T 70/409; Y10T 70/491; Y10T 70/5854; Y10T 70/5779; Y10T 70/5982; Y10T 70/7921; Y10S 70/57; B62D 43/007; E05B 73/00; E05B 73/0017; E05B 9/082; E05B 67/22; E05B 65/00; F16B 41/005; B61C 17/00; B61K 13/00

USPC ..... 70/DIG. 57, DIG. 34; 248/552; 224/42.25

See application file for complete search history.

(56) References Cited

U.S. PATENT DOCUMENTS

| | | | | |
|---|---|---|---|---|
| 2,198,026 | A | 4/1940 | Farmer | |
| 2,299,447 | A | 10/1942 | Wood | |
| 2,521,148 | A * | 9/1950 | Buell | 116/142 R |
| 3,710,752 | A | 1/1973 | Heehler et al. | |
| 4,438,642 | A | 3/1984 | De Jong | |
| 4,444,031 | A | 4/1984 | Watson | |
| 4,516,109 | A * | 5/1985 | Thurston | 340/908.1 |

(Continued)

FOREIGN PATENT DOCUMENTS

JP 2008208587 A 9/2008

OTHER PUBLICATIONS

Yahoo Groups, "Re: How to Prevent Horn Theft—Any Suggestions?," dated Apr. 22, 2003, http://groups.yahoo.com/group/Horn_Whistle/message/5501?o+1&d=-1.

(Continued)

*Primary Examiner* — Mark Le
(74) *Attorney, Agent, or Firm* — Pillsbury Winthrop Shaw Pittman, LLP

(57) ABSTRACT

An anti-theft device for use with a locomotive horn is disclosed. An angled L-shaped bracket of the anti-theft device has a horizontal portion that is connected to an anti-theft or tamper proof fastener used to attach a base of the horn to the locomotive. A vertical portion of the bracket receives a shackle portion of a padlock for connection with and locking on the bracket. A bushing is placed on the shackle portion of the padlock over the anti-theft fastener to limit slack of the padlock relative to the bracket. When assembled with the locomotive horn, the anti-theft device at least partially covers the anti-theft fastener such that access to and/or removal of at least the anti-theft fastener is substantially prevented. Thus, theft of the horn is reduced and/or prevented.

20 Claims, 7 Drawing Sheets

(56) References Cited

U.S. PATENT DOCUMENTS

| | | | | |
|---|---|---|---|---|
| 4,736,603 | A | 4/1988 | Brushaber | |
| 4,761,975 | A | 8/1988 | Kachnowski et al. | |
| 4,799,369 | A | 1/1989 | Goodson et al. | |
| 5,078,437 | A | 1/1992 | Borgmeyer et al. | |
| 5,447,044 | A | 9/1995 | Cheng | |
| 5,447,045 | A | 9/1995 | Cheng | |
| 5,740,685 | A | 4/1998 | Daoud | |
| 5,797,285 | A | 8/1998 | Sackowitz | |
| 6,109,077 | A * | 8/2000 | Lee | 70/232 |
| 6,257,032 | B1 | 7/2001 | Cecil | |
| 6,684,548 | B1 | 2/2004 | Petrus | |
| 6,718,803 | B2 | 4/2004 | Knoll | |
| 6,732,556 | B1 | 5/2004 | Russell | |
| 6,820,362 | B1 | 11/2004 | Petrus | |
| 7,971,458 | B2 | 7/2011 | Gilbert | |
| 2004/0093914 | A1 | 5/2004 | Vito | |
| 2008/0134729 | A1 | 6/2008 | Loughlin et al. | |

OTHER PUBLICATIONS

Train Orders, "Eastern Railroad Discussion, Horn Theft," dated Jan. 5-9, 2008, http://www.trainorders.com/discussion/read.php?2,1570976.

Train Orders, "Western Railroad Discussion, Missing Air Horn?," dated Mar. 28-29, 2008, http://www.trainorders.com/discussion/read.php?1,1637276.

Trainz Discussion Forums, "Stolen Horns @ TVRM," dated Jul. 7-Dec. 10, 2008, http://forums.auran.com/trainz/archive/index.php/t-28007.html.

* cited by examiner

ANTI-THEFT DEVICE FOR A LOCOMOTIVE HORN

BACKGROUND

1. Field

The present invention is generally related to an anti-theft device for preventing removal of a horn on a locomotive.

2. Description of Related Art

Theft of locomotive horns has been a problem in the railroad industry, and can be costly to replace. To reduce horns from being stolen, some users have tried installing high security or anti-theft bolts to secure or mount a base of the horn to the locomotive. However, thieves are able to buy a matching drive or removal device to remove such bolts. Others have tried welding bolts, tabs, and/or collars at mounting portion of the horn and/or over bolts and/or fasteners, but such welds can be ground off to remove the horn. Even if multiple types of bolts and fasteners are used to mount the base of the horn to the locomotive, thieves have found methods for removing horns from the locomotive.

SUMMARY

It is an aspect of this disclosure to provide an anti-theft device for use with a locomotive horn, the horn configured for attachment to a locomotive using a plurality of fasteners through its base. The anti-theft device includes: an angled bracket; a padlock; and a bushing. The angled bracket has a first plate portion and a second plate portion that are connected and angled relative to each other. Each one of the first portion and the second portion has an opening therein. The opening in the first portion of the angled bracket is configured for receipt of an attachment fastener that is one of the plurality of fasteners used for attachment of the base of the horn to a surface of the locomotive. The opening in the second portion is configured for receipt of the padlock. The padlock has a body and a shackle portion. The shackle portion has one end connected to the body and a second end removably connected to the body for moving between locked and unlocked positions. The padlock is configured for connection to the angled bracket via insertion of the second end of the shackle portion through the opening in the second portion of the angled bracket and locking the second end of the shackle portion to the body in the locked position. The bushing is configured for placement on the shackle portion substantially over the attachment fastener and configured to limit slack of the padlock relative to the angled bracket with the second end of the shackle portion in its locked position. The anti-theft device is configured to at least partially cover the attachment fastener attaching the first portion of the angled bracket to the horn such that access to and/or removal of at least the attachment fastener is substantially prevented.

Another aspect provides a locomotive including: a body; track engaging wheels; a power system in the body for driving the wheels to move the locomotive along a pair of tracks; a horn, the horn having base attached to a surface of the locomotive using a plurality of fasteners; and an anti-theft device for the horn. The anti-theft device includes: an angled bracket; a padlock; and a bushing. The angled bracket has a first plate portion and a second plate portion that are connected and angled relative to each other. Each one of the first portion and the second portion has an opening therein. An attachment fastener that is one of the plurality of fasteners used for attachment of the base of the horn to the surface of the locomotive is received in the opening in the first portion of the angled bracket. The padlock is received in the opening in the second portion. The padlock has a body and a shackle portion. The shackle portion has one end connected to the body and a second end removably connected to the body for moving between locked and unlocked positions. The padlock is connected to the angled bracket in its locked position via insertion of the second end of the shackle portion through the opening in the second portion of the angled bracket. The bushing is positioned on the shackle portion substantially over the attachment fastener and configured to limit slack of the padlock relative to the angled bracket. The anti-theft device is configured to at least partially cover the attachment fastener attaching the first portion of the angled bracket to the horn such that access to and/or removal of at least the attachment fastener is substantially prevented.

Yet another aspect of this disclosure provides an anti-theft device for use with a locomotive horn, the horn configured for attachment to a locomotive using a plurality of fasteners through its base. The anti-theft device includes: an angled bracket; a padlock; and a bushing. The angled bracket has a first plate portion and a second plate portion that are angled relative to each other. Each one of the first portion and the second portion has an opening therein. The opening in the first portion of the angled bracket is configured for receipt of an attachment fastener that is one of the plurality of fasteners used for attachment of the base of the horn to a surface of the locomotive. The opening in the second portion is configured for receipt of the padlock. The padlock has a body and a shackle portion. The shackle portion has one end connected to the body and a second end removably connected to the body for moving between locked and unlocked positions. The padlock is configured for connection to the angled bracket via insertion of the second end of the shackle portion through the opening in the second portion of the angled bracket and locking the second end of the shackle portion to the body in the locked position. The bushing is configured for placement on the shackle portion substantially over the attachment fastener and configured to limit slack of the padlock relative to the angled bracket with the second end of the shackle portion in its locked position. The bushing is configured to at least partially cover the attachment fastener attaching the first portion of the angled bracket to the horn such that access to and/or removal of at least the attachment fastener is substantially prevented.

Other features and advantages of the present invention will become apparent from the following detailed description, the accompanying drawings, and the appended claims.

DETAILED DESCRIPTION OF THE PREFERRED EMBODIMENT(S)

In order to reduce or prevent theft of locomotive horns that are typically only secured using fasteners or bolts, disclosed herein is an anti-theft device for a horn that is attached to a locomotive with fasteners. The anti-theft device prevents access to at least one of the fasteners or bolts used to attach the horn to the locomotive. Accordingly, it prevents removal of the fastener and thus the horn.

Figure 1:
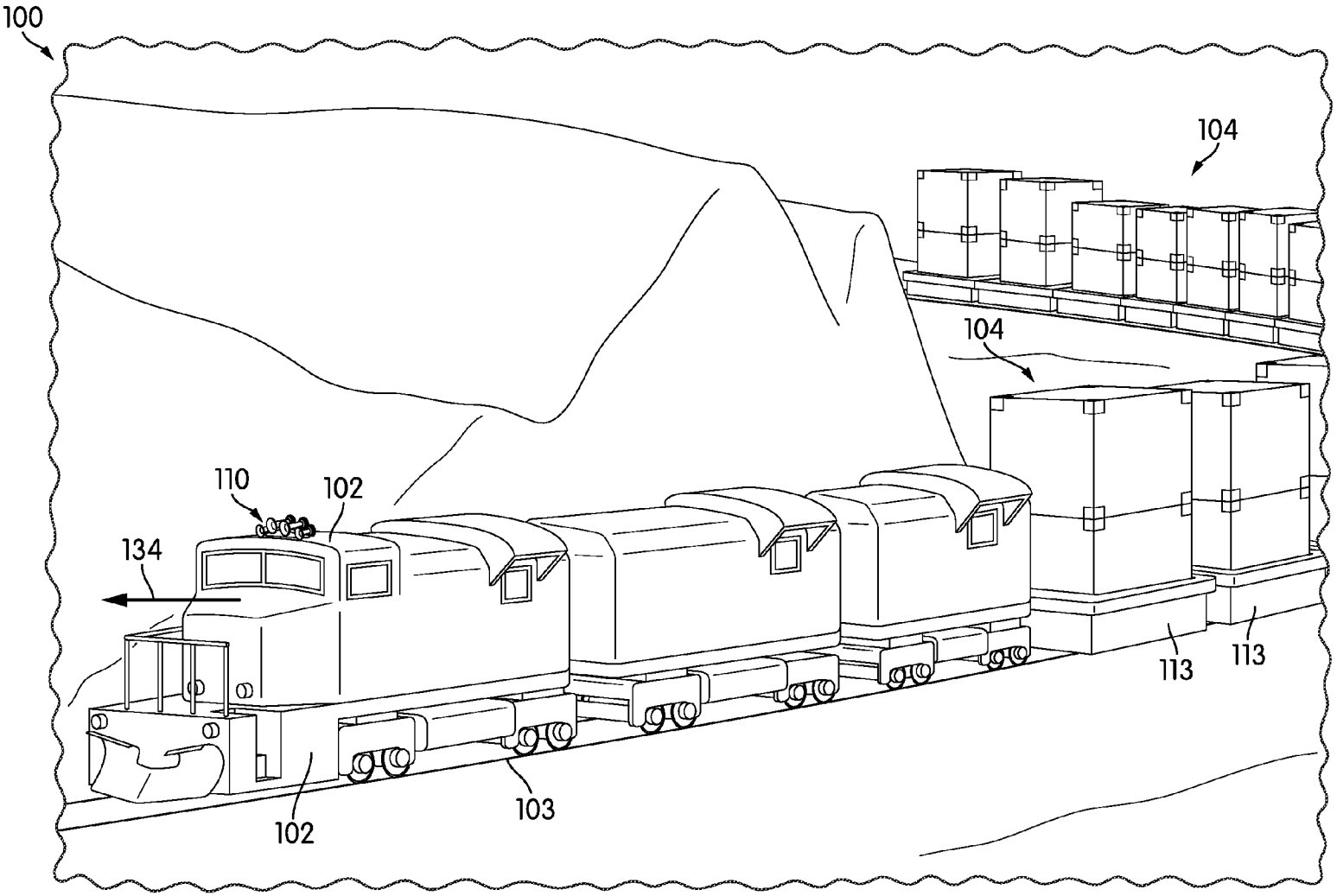
FIG. 1 illustrates a train comprising a locomotive pulling a series of cars.

Referring now more particularly to the drawings, FIG. 1 illustrates a train 100 comprising a locomotive 102 pulling a series 104 of cars 113. The term "locomotive" as provided herein refers to a device which assists in moving cars in a train. The locomotive 102 comprises track engaging wheels and a power system. The power system is located in a body of the locomotive and provides power for driving the wheels to move the locomotive along a pair of tracks 103 or rails. The locomotive 102 may be a vehicle that is diesel-powered, for example, and configured to pull containers in a series 104 via wheels of cars 113 or wheeled containers or boxes on the pair of railroad tracks or rails 103, to move freight or passengers, as is known in the art. In some cases, at least one (e.g., remote) locomotive may be provided along the length of the train between a first car with one or more containers and a second car with one or more containers to assist in transporting the cars/containers along the track 103. The locomotive 102 and/or remote locomotive may be manufactured according to any number of designs or standards. In some embodiments, locomotive 102 and/or remote locomotive may comprise an existing manufactured model. One or more horns such as horn 110 shown in FIG. 4 may be attached to the locomotive 102 and/or remote locomotive(s) along the length of the train 100.

Figure 2:
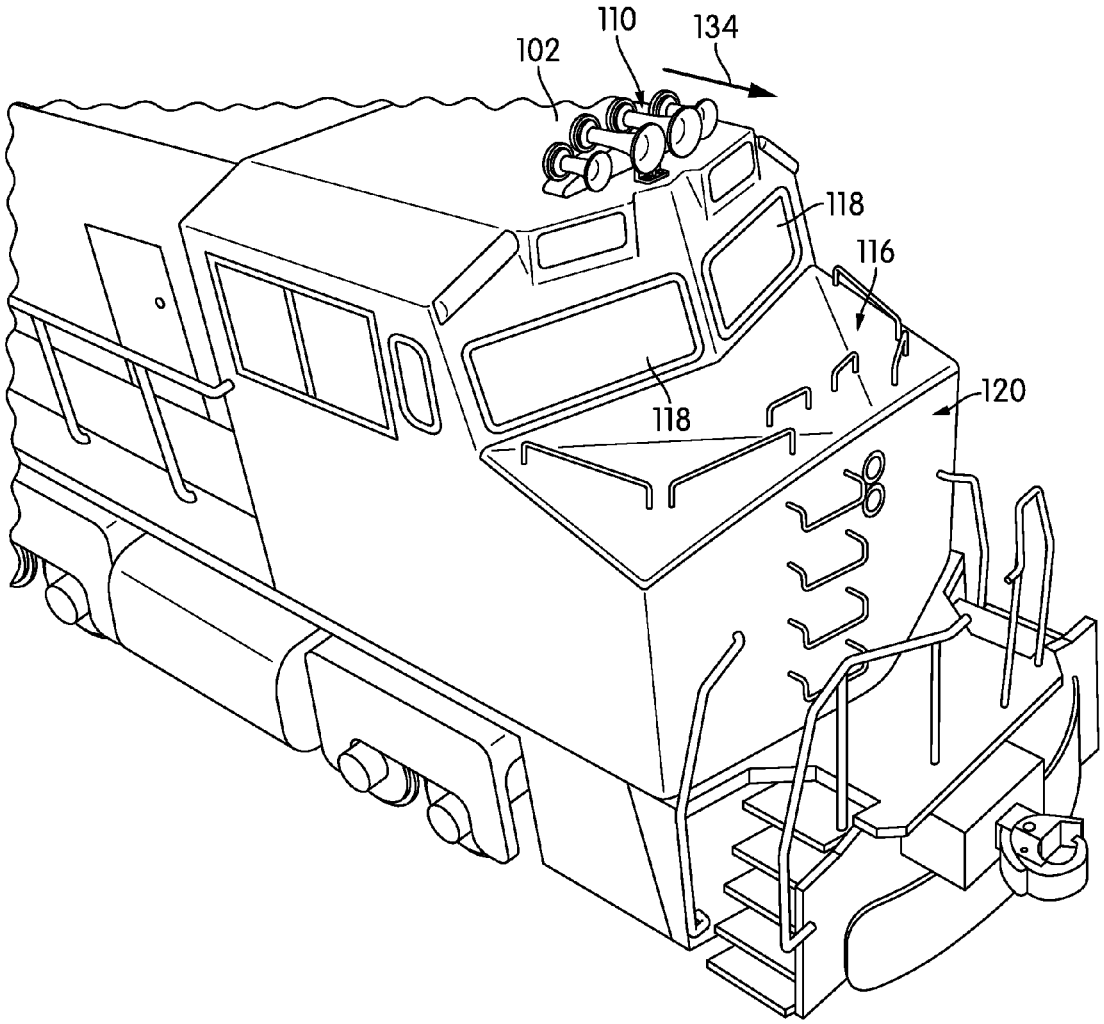
FIG. 2 illustrates a perspective view of a front end of a locomotive on a train such as shown in FIG. 1.
Figure 3:
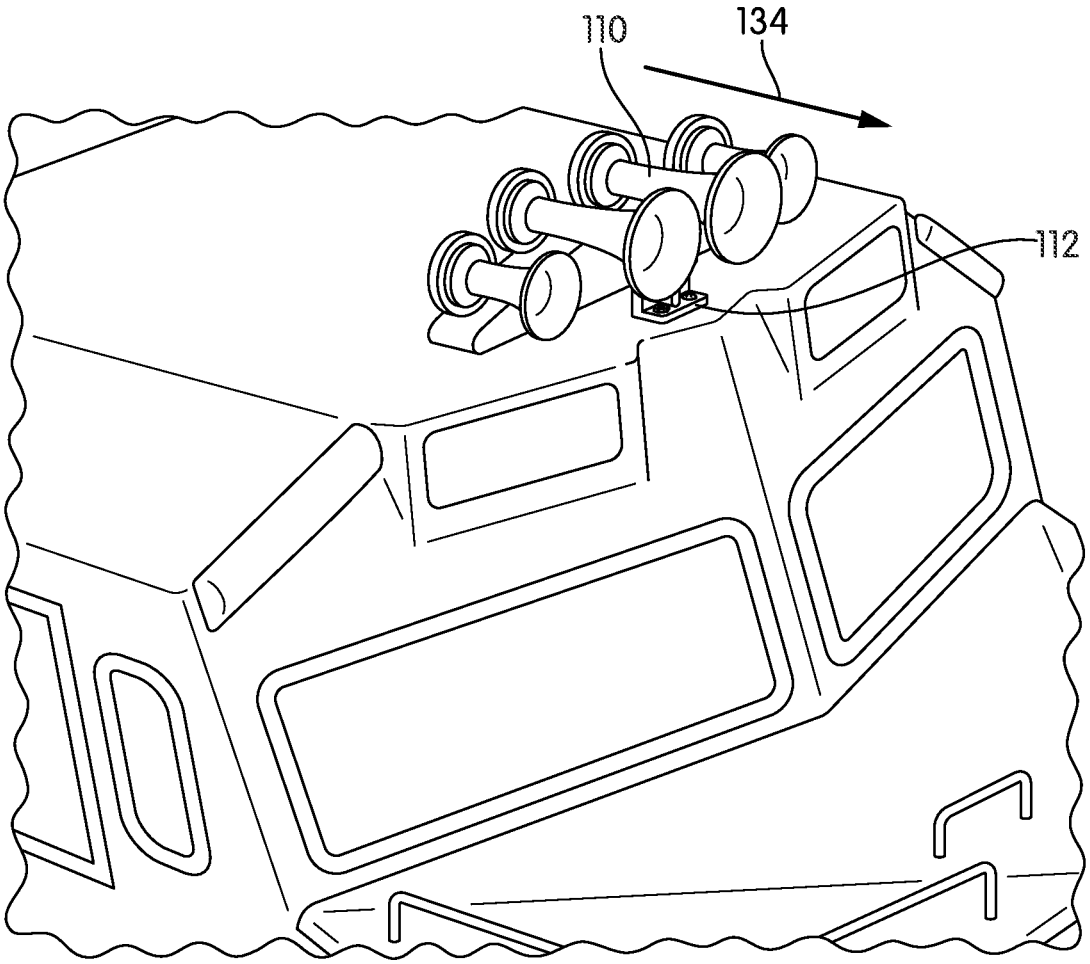
FIG. 3 illustrates a detailed view of part of a front face of the front end of the locomotive of FIG. 2 having a locomotive horn thereon.

For example, FIGS. 2 and 3 illustrate horn 110 mounted or placed at an example location on locomotive 102. As shown, the body of the locomotive 102 is generally of longitudinal shape. Locomotive 102 comprises a front end and back end (not shown), the front end provided at a first longitudinal end of the body and the back end provided at a second, opposite longitudinal end of the body. The front end may be a leading end when the train 100 is in motion, for example. The locomotive 102 may also include an underframe (or platform), a front and/or pilot snow plow, one or more walkways and step areas, and hand rail areas, as generally known by those of skill in the art. Locomotive 102 also comprises a front face 116. The front face 116 may include a front nose 120 and one or more windshields 118, for example. The windshield(s) 118 may allow an operator in the locomotive to see a route along the track 103, for example. Horn 110 may be secured to a roof (e.g., see FIG. 3), a front portion, a front face (e.g., front face 116 shown in FIG. 2), a top portion, or near a top portion or a front portion of a locomotive using its base 112. FIG. 3 shows in greater detail a locomotive horn 110 secured on a surface, e.g., roof of a locomotive 102. However, as noted, the horn may be secured to any number of areas or surfaces on the locomotive 102 and is not limited to the depictions shown in FIGS. 2 and 3. Also, one or more horns may be secured to one or more surfaces of the locomotives, containers, and/or cars along the length of the train 100. One or more horns may also be provided along the length of the train 100.

Figure 4:
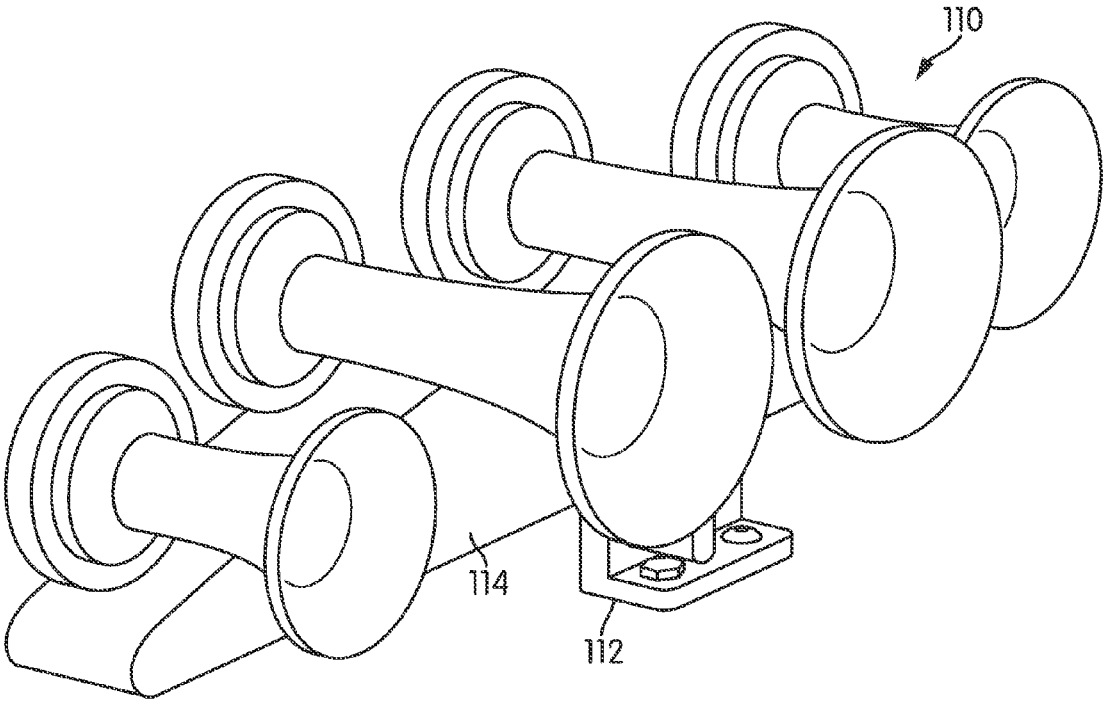
FIG. 4 illustrates an example of a locomotive horn for attachment to a locomotive.
Figure 6:
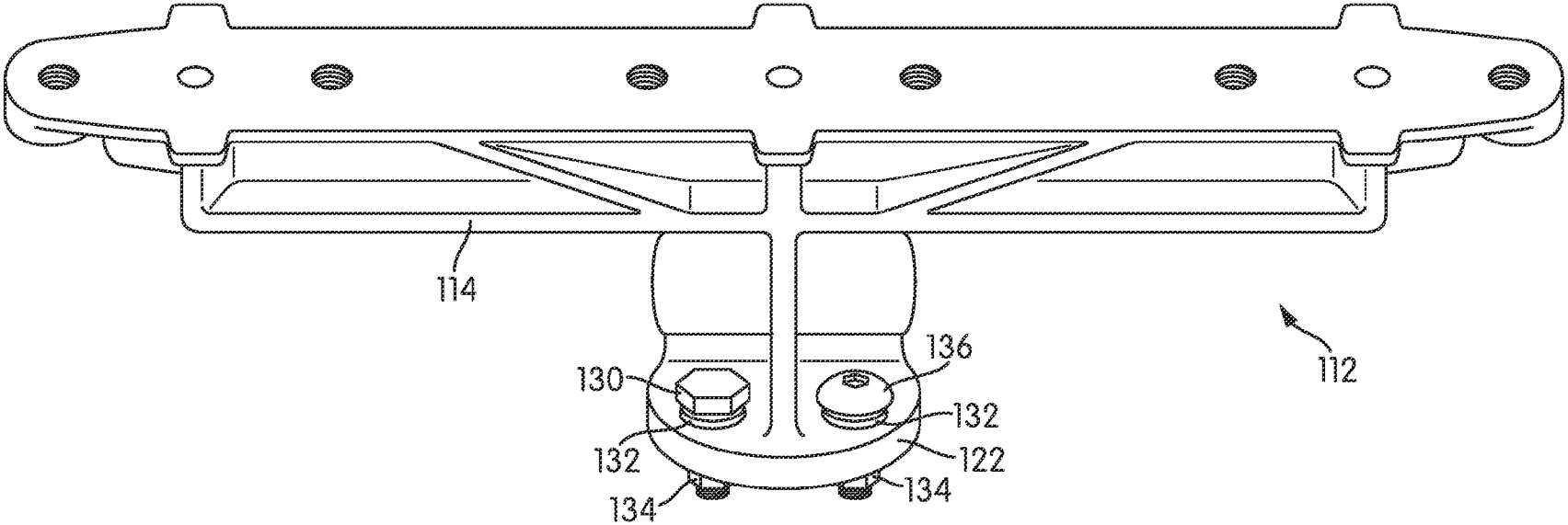
FIG. 6 illustrates a side perspective view of an exemplary base of the locomotive horn of FIG. 4 with two types of fasteners for attachment to a top of a locomotive.

FIG. 4 illustrates an example of a locomotive horn 110 for attachment to a surface of a locomotive that can be secured with the herein disclosed anti-theft device, described below. The horn 110 has a base 112 that is configured for holding bells or chimes and for attachment to a surface of the locomotive using a plurality of fasteners, for example. Base 112 of horn 110 is used to secure or mount the horn 110 to the selected surface. Base 112 has a mounting portion 122 (see FIG. 6) with at least two openings for receipt of fasteners or bolts therethrough. In some embodiments, mounting portion 122 has four openings for receipt of fasteners or bolts therethrough and for attachment of the horn to the locomotive. FIG. 6 shows a more detailed view of a side of an exemplary mounting portion 122 of horn 110 used for mounting a locomotive horn on a locomotive. As shown, the base 112 can include a mounting portion 122 connected to a body portion 114. Mounting portion 122 has any number of openings therein for receipt of fasteners, bolts, or the like. Although not specifically shown in FIG. 6, the fasteners and/or bolts are configured for insertion through the mounting portion 122 of the base 112 as well as the surface of the locomotive in order to secure horn 110 to the locomotive 102. One or more washers 132 can be used with each fastener or bolt. Nuts 134 can be used and tightened on ends of the fasteners and/or bolts inserted through the mounting portion 122 and the surface of the locomotive (e.g., on an opposite side of the surface) to secure the mounting portion 122 of the base 112 to the surface of the locomotive. Additional details regarding the mounting of the base 112 of horn 110 as shown in FIG. 6 in accordance with this disclosure are provided further below.

Figure 9:
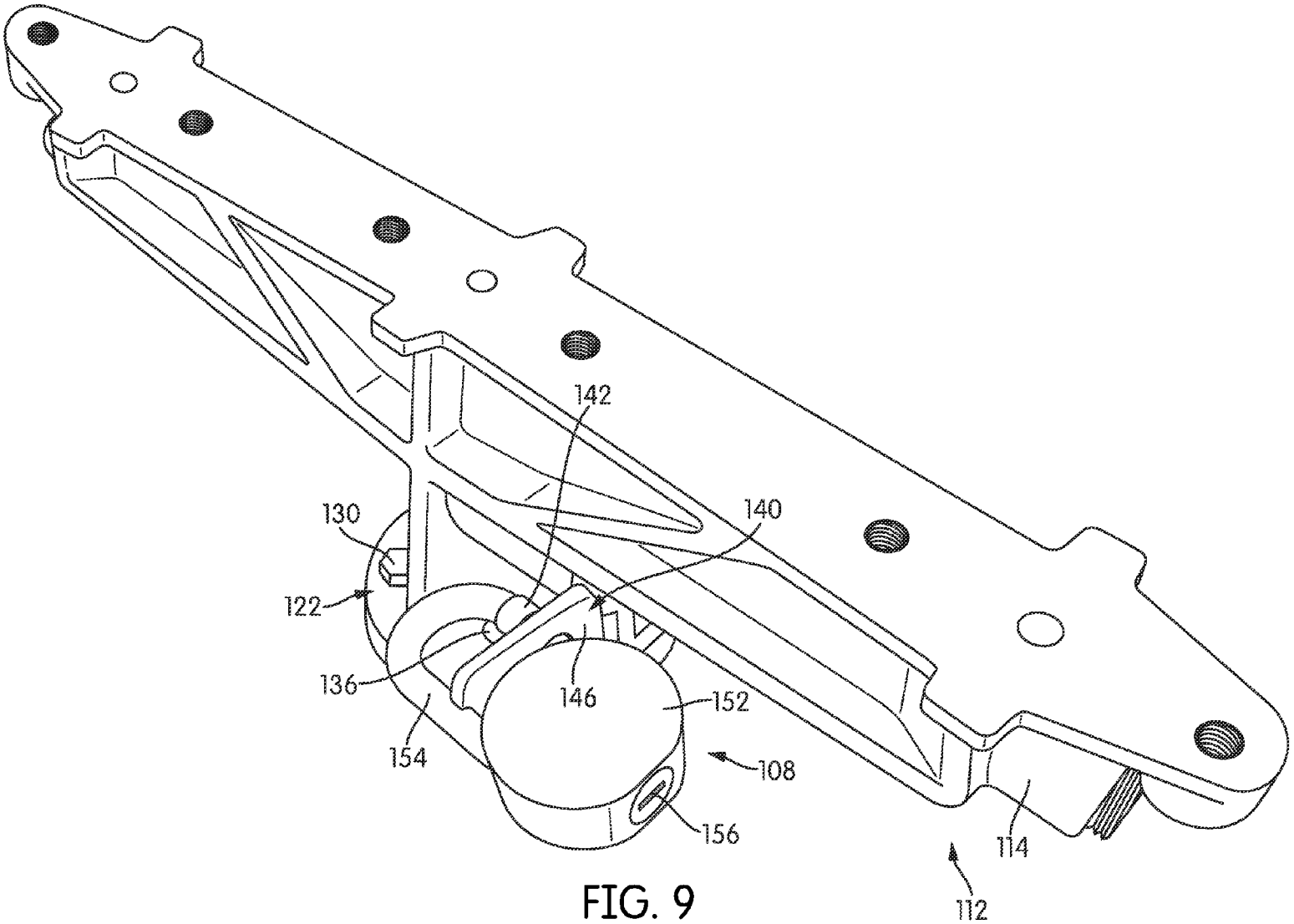
FIG. 9 illustrates a perspective view of the installed anti-theft device and padlock on the base of the locomotive horn.

Base portion 112 of horn 110 also has body portion 114 or manifold which contains a sound producing mechanism operable by compressed air introduced via an input (e.g., pipe) and one or more bells secured to the body portion 114. As understood by one of ordinary skill in the art, the body portion 114 and/or sound producing device can be mounted on a locomotive or other vehicle with the open end(s) of the bell(s) facing in the direction in which the locomotive is normally driven, as shown in FIGS. 2 and 3, for example. In an embodiment, three to five bells or chimes are used on horn 110. Any number of horns, bells, or chimes, however, may be associated with the body portion 114. The chimes can also have any number of configurations and is not limiting. For example, the chimes can be arranged along a length of a longitudinally extending manifold or body portion 114, such as shown in FIG. 4 or FIG. 9, or stacked (or partially stacked) on top of one another, or provided on a circular shaped manifold. The direction of the bells is also not limited.

Any other parts that which make up the horn are not discussed in detail herein, as such parts and/or features should be understood by one of ordinary skill in the art. For example, it should be understood by one of ordinary skill in the art that such horns may include any number of chambers and/or diaphragms and that said chambers and/or diaphragms may vary in size or be substantially similar in size without being limited to particular parts or shapes. In accordance with embodiments, the herein disclosed anti-theft device may be used with any type of horn, including but not limited to those manufactured by Nathan AirChime, Leslie, or Westinghouse Air Brake Company. The disclosed anti-theft device can be used with any type or model of air horn, and is not intended to be limiting.

In accordance with embodiments, an anti-theft device 108 is used with a locomotive horn such as horn 110 to substantially reduce and/or prevent removal of the horn from the surface of the locomotive (or other surface) to which it is mounted or attached.

Figure 5:
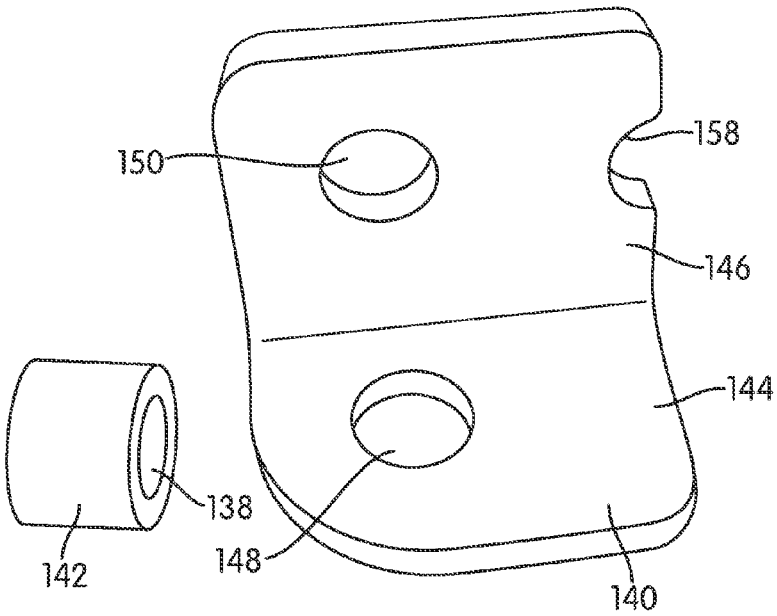
FIG. 5 illustrates parts of an anti-theft device for use with a base of a locomotive horn in accordance with an embodiment of the present invention.

FIG. 5 shows parts of anti-theft device 108 in accordance with embodiments of this disclosure. The anti-theft device 108 includes an angled bracket 140, a padlock 152 (e.g., see FIG. 7), and a bushing 142. The angled bracket 140 is configured for attachment to the mounting portion 122 of the horn 110. In accordance with embodiments, angled bracket 140 is configured for receipt of an attachment fastener 136 that is one of the plurality of fasteners used for attachment of the mounting portion 122 of base 112 of the horn 110 to a surface of the locomotive 102), in order to attach the angled bracket 140 to the mounting portion 122. As shown in greater detail in FIG. 6, in accordance with embodiments, at least one attachment fastener 136 and a bolt 130 are used in mounting portion 122 of the horn 110.

In accordance with embodiments, at least two types of fasteners are used for attachment of base 112 to a locomotive. That is, another or the other(s) of the plurality of fasteners used for attachment of the base 112 of the horn 110 to the surface of the locomotive 102 can be a different type(s) of fastener(s) than the at least one attachment fastener 136. For example, fastener(s) 130 in the form of bolt(s) may be used for attachment through the remaining opening(s) of mounting portion 122 along with an attachment fastener 136 in another opening. In accordance with embodiments, the at least one attachment fastener 136 is an anti-theft or tamper proof bolt. The attachment fastener 136 can be a security fastener, a tamper proof fastener, an anti-theft fastener, or anti-tamper fastener. The attachment fastener 136 may be designed to be theft deterrent. In accordance with embodiments, other fasteners such as fastener(s) 130 may also be theft deterrent. In at least one embodiment, the at least one attachment fastener 136 has a custom drive and/or pattern combination that is designed for receipt of a special key, tool, or driver to rotate the attachment fastener 136. For example, attachment fastener 136 can have a center pin with a pentagonal, hexagonal, star, or other shaped receiving portion designed to receive a key, a tool, or a driver for rotation thereof. This can enable or ensure control of user(s) whom have access to securing/unsecuring the attachment fastener 136 to a surface of a locomotive.

In one embodiment, attachment fastener 136 is a fastener or bolt having a hex pin head. In another embodiment, attachment fastener 136 is a sheer away security bolt, e.g., a bolt with a shearing head that shears off once the fastener reaches a specific torque limit (thereby breaking off its head and leaving an installed fastener.

Referring back to FIG. 5, angled bracket 140 has a first plate portion 144 and a second plate portion 146 that are connected and angled relative to each other. As better shown in FIG. 7, in embodiments, the angled bracket 140 is an L-shaped bracket. The first portion 144 and the second portion 146 are a substantially horizontal portion and a substantially vertical portion, respectively, which are relatively positioned in a substantially perpendicular configuration. The first and second portions 144 and 146 of the angled bracket 140 can be integrally formed or attached or connected (e.g., welded) to each other. When the bracket 140 is integrally formed, for example, a substantially flat, singular piece of metal may be bent or shaped to form angled bracket 140. The angled bracket 140 can be one-piece. Formation or manufacture of angled bracket 140 may include joining pieces together prior to use of the bracket 140, with the connection having no mechanical joints.

Each one of the first portion 144 and the second portion 146 has an opening therein. As shown in FIG. 5, first portion 144 has opening 148 and second portion 146 has opening 150. The placement of the openings 148 and 150 can be designed based on the dimensions and features of the mounting portion 122 of the horn 110. The opening 148 in the first portion 144 of the angled bracket 140 is configured for receipt of attachment fastener 136 used for attachment of the base 112 of the horn 110 to a surface of the locomotive 102. The opening 150 in the second portion 146 is configured for receipt of the padlock 152. Accordingly, the placement of the openings 148 and 150 can be provided to accommodate the attachment fastener 136 location while still allowing for attachment of the padlock 152. In embodiments, the second portion 146 includes a curved recessed portion 158 at an edge thereof, which is configured to accommodate a shackle portion 154 of the padlock 152 when it is attached and secured through the opening 150 (e.g., see FIG. 7). The curved recessed portion 158 can be substantially horizontally aligned with the opening 150 in the second portion 146.

Figure 7:
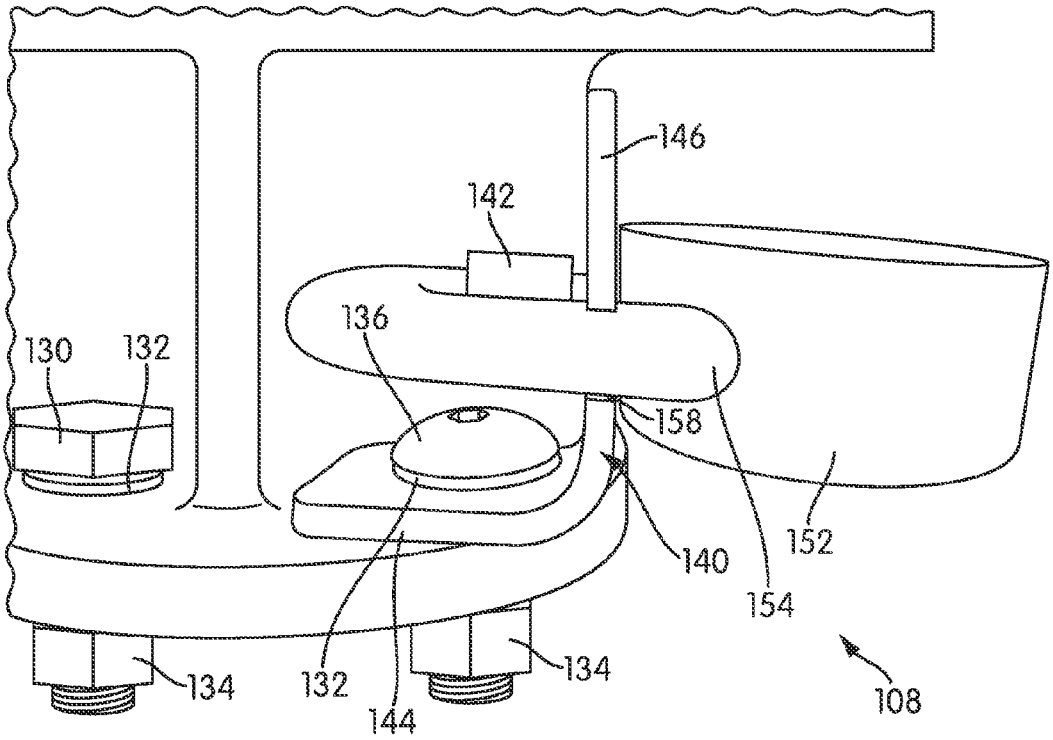
FIG. 7 illustrates a side view of the anti-theft device of FIG. 6 installed with a padlock on a base of a locomotive horn in accordance with an embodiment of the present invention.
Figure 8:
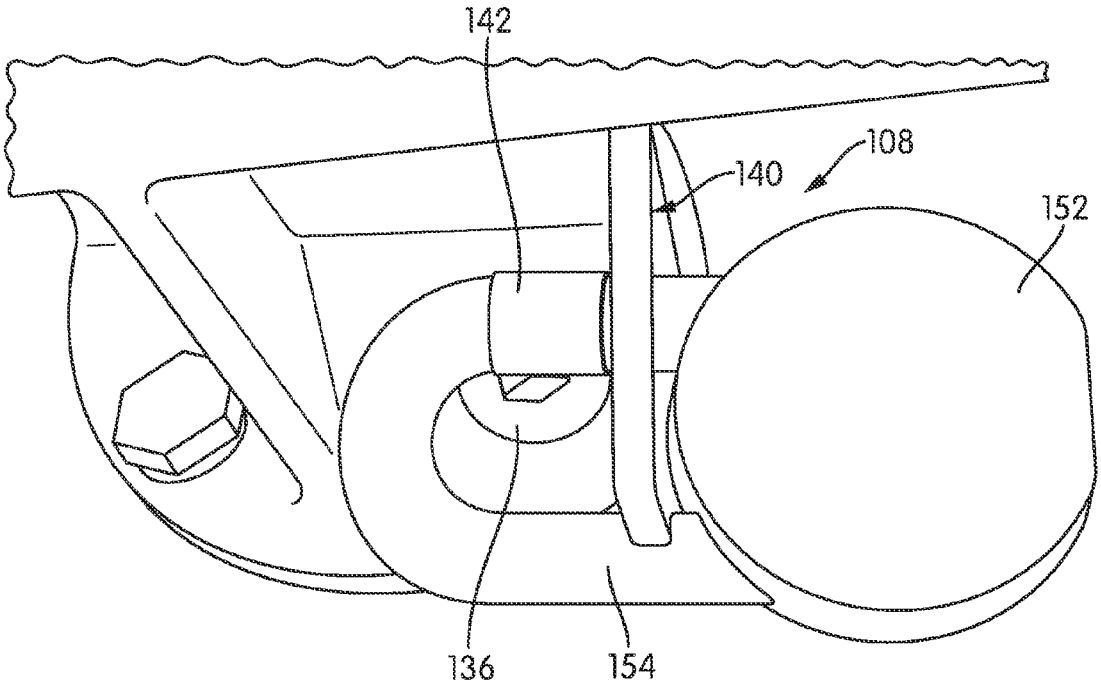
FIG. 8 illustrates a top view of the anti-theft device and padlock as installed on the base of the locomotive horn of FIG. 7.

As noted, the padlock 152 is configured for connection to the angled bracket 140 via insertion of the second end of the shackle portion 154 through the opening 150 in the second portion 150 of the angled bracket 140 and locking the second end of the shackle portion 154 to the body in the locked position, which is shown in FIGS. 7-9. In embodiments, when locked, the padlock 152 is positioned in substantially parallel configuration relative to the first portion 144 and/or the surface of the locomotive to which the anti-theft device 108 is attached. The padlock 152 includes a body with an arm or a shackle portion 154. The shackle portion 154 has one end connected to the body and a second end removably connected to the body for moving between locked and unlocked positions. The body of padlock 152 has a locking mechanism therein (not shown) and is configured for receipt of a key or a disassembly tool through its (key) entry or receipt portion 156 to lock and/or unlock the shackle portion 154. In one embodiment, the locking mechanism in the padlock 152 is a pin and tumbler construction. It may or may not have an optional locking cam. As shown in FIG. 9, the receipt portion 156 may be provided in a bottom of the body of padlock 152. It can alternatively be provided on a side or top or bottom surface. In another embodiment, in addition to or instead of receipt portion 156, a locking combination can be provided.

The shackle portion 154 of padlock 156 may be made of hardened steel, for example, to prevent cutting or snapping thereof, and thus removal of the padlock 152 from the angled bracket 140. Other material(s) can alternatively or also be used to form at least the shackle portion 154. To further reduce access to the attachment fastener 136 and limit slack of the padlock 152, bushing 142 is provided on shackle portion 154 of padlock 152 when attached to angled bracket 140. As shown in FIG. 5, the bushing 142 has a through hole for receipt of the shackle portion 154 of the padlock 152 therethrough. The bushing 142 is configured for placement on the shackle portion 154 and placed substantially over the attachment fastener 136. The bushing 142 protects the attachment fastener 136 from being accessed. Accordingly, when installed, such as shown in FIGS. 7-9, the anti-theft device 108 is configured to at least partially cover the attachment fastener 136 attaching the first portion 144 of the angled bracket 140 to the horn 110 such that access to and/or removal of at least the attachment fastener 136 is substantially prevented. The bushing 142 is also configured to substantially reduce, limit, and/or eliminate any slack, leeway, or give of the padlock 152 relative to the angled bracket 140 when the second end of the shackle portion 154 is locked in position to the body (e.g., see FIG. 8). The shackle portion 154 is received in opening 150 and curved recessed portion 158 of the angled bracket 140.

The bushing 142 can be formed from materials that are tough to cut through. For example, in an embodiment, the bushing 142 can be formed using hardened steel.

Alternatively, in embodiments, the bushing 142 can be built into the padlock (e.g., on the shackle portion). In accordance with embodiments, the padlock 152 can be an armored padlock with a built in bushing 142.

To assemble and install the anti-theft device 108, the angled (or L-shaped) bracket 140 is attached to the mounting portion 112 of the horn 110 by aligning the opening 148 of the first portion 144 of the bracket 140 with the opening in the mounting portion 122. The opening in the mounting portion 122 is aligned with an opening in the surface of the locomotive, for example. A washer (i.e., its opening) 132 is optionally aligned with the openings. A threaded portion and/or shank of the attachment fastener 136 is inserted through the aligned openings of the (optional) washer 132, opening 148 of the second portion 144, and opening in the mounting portion 122, as well as the opening in the surface of the locomotive. The attachment fastener 136 is secured by a nut 134 on an end of its threaded portion. The bushing 142 is slipped on the shackle portion 154 of the padlock and the second end of the shackle portion 154 of the padlock 152 is placed through the opening 150 in the extended second portion 146 of bracket 140. The first end is aligned in the curved recessed portion 158 of the second portion 146. The second end of the shackle portion is locked with the body of the padlock, thus blocking access to the attachment fastener 136. Accordingly, the installed combination of an L-bracket or angled bracket 140, padlock 152, and bushing 142 as the anti-theft device 108 on the locomotive horn 110 substantially shields and prevents removal of and denies access to the attachment fastener 136 (e.g., the anti-theft bolt), as shown in FIGS. 7-9. Since access to at least the attachment fastener 136 of the horn 110 attached to the locomotive is prevented, any tool or other device cannot be used to remove the attachment fastener 136.

The herein disclosed anti-theft device 108 can be applied to any locomotive horn without any welding, additional fasteners, etc. required. Besides limiting access to the attachment fastener 136, it also facilitates key-only access (e.g., to padlock 152 as well as to attachment fastener 136) for replacement of the horn 110. It acts as a deterrent to thieves who may grind or attempt removal of bolts and/or welds, and improves security against theft.

Also, the herein described padlock can be a lock that is standard issue in the railroad industry. Accordingly, costs for implementing the disclosed anti-theft device can remain low.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that the features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. An anti-theft device for use with a locomotive horn, the horn configured for attachment to a locomotive using a plurality of fasteners through its base, the anti-theft device comprising:

an angled bracket;

a padlock; and a bushing;

the angled bracket comprising a first plate portion and a second plate portion that are angled relative to each other, each one of the first portion and the second portion comprising an opening therein, the opening in the first portion of the angled bracket being configured for receipt of an attachment fastener that is one of the plurality of fasteners used for attachment of the base of the horn to a surface of the locomotive and the opening in the second portion being configured for receipt of the padlock, the padlock comprising a body and a shackle portion, the shackle portion having one end connected to the body and a second end removably connected to the body for moving between locked and unlocked positions, the padlock configured for connection to the angled bracket via insertion of the second end of the shackle portion through the opening in the second portion of the angled bracket and locking the second end of the shackle portion to the body in the locked position, the bushing configured for placement on the shackle portion, located substantially over the attachment fastener., and configured to limit slack of the padlock relative to the angled bracket with the second end of the shackle portion in its locked position, and wherein a portion of the shackle portion and the bushing of the anti-theft device are configured to at least partially cover the attachment fastener attaching the first portion of the angled bracket to the horn such that access to and/or removal of at least the attachment fastener is substantially prevented.

2. The device according to claim 1, wherein the angled bracket is an L-shaped bracket, and wherein the first portion and the second portion comprise a substantially horizontal portion and a substantially vertical portion, respectively, that are relatively positioned in a substantially perpendicular configuration.

3. The device according to claim 1, wherein the attachment fastener is an anti-theft or tamper proof bolt.

4. The device according to claim 1, wherein another of the plurality of fasteners used for attachment of the base of the horn to the surface of the locomotive is different than the attachment fastener.

5. The device according to claim 1, wherein the padlock is positioned in substantially parallel configuration relative to the surface of the locomotive when the padlock is connected to the angled bracket.

6. The device according to claim 1, wherein the padlock is provided in a substantially horizontal configuration relative to the surface of the locomotive when the padlock is connected to the angled bracket.

7. The device according to claim 1, wherein the bushing has a through hole for receipt of the shackle portion of the padlock therethrough.

8. A locomotive comprising:

a body;

track engaging wheels;

a power system in the body for driving the wheels to move the locomotive along a pair of tracks;

a horn, the horn having base attached to a surface of the locomotive using a plurality of fasteners; and an anti-theft device for the horn, the anti-theft device comprising:

an angled bracket;

a padlock; and a bushing;

the angled bracket comprising a first plate portion and a second plate portion that are angled relative to each other, each one of the first portion and the second portion comprising an opening therein, an attachment fastener that is one of the plurality of fasteners used for attachment of the base of the horn to the surface of the locomotive being received in the opening in the first portion of the angled bracket and the padlock being received in the opening in the second portion, the padlock comprising a body and a shackle portion, the shackle portion having one end connected to the body and a second end removably connected to the body for moving between locked and unlocked positions, the padlock being connected to the angled bracket in its locked position via insertion of the second end of the shackle portion through the opening in the second portion of the angled bracket, the bushing positioned on the shackle portion, located substantially over the attachment fastener, and configured to limit slack of the padlock relative to the angled bracket, and wherein a portion of the shackle portion and the bushing of the anti-theft device are configured to at least partially cover the attachment fastener attaching the first portion of the angled bracket to the horn such that access to and/or removal of at least the attachment fastener is substantially prevented.

9. The locomotive according to claim 8, wherein the angled bracket is an L-shaped bracket, and wherein the first portion and the second portion comprise a substantially horizontal portion and a substantially vertical portion, respectively, that are relatively positioned in a substantially perpendicular configuration.

10. The locomotive according to claim 8, wherein the attachment fastener is an anti-theft or tamper proof bolt.

11. The locomotive according to claim 8, wherein another of the plurality of fasteners used for attachment of the base of the horn to the surface of the locomotive is different than the attachment fastener.

12. The locomotive according to claim 8, wherein the padlock is positioned in substantially parallel configuration relative to the surface of the locomotive.

13. The locomotive according to claim 8, wherein the padlock is provided in a substantially horizontal configuration relative to the surface of the locomotive.

14. The locomotive according to claim 8, wherein the bushing has a through hole for receipt of the shackle portion of the padlock therethrough.

15. An anti-theft device for use with a locomotive horn, the horn configured for attachment to a locomotive using a plurality of fasteners through its base, the anti-theft device comprising:

an angled bracket;

a padlock; and a bushing;

the angled bracket comprising a first plate portion and a second plate portion that are angled relative to each other, each one of the first portion and the second portion comprising an opening therein, the opening in the first portion of the angled bracket being configured for receipt of an attachment fastener that is one of the plurality of fasteners used for attachment of the base of the horn to a surface of the locomotive and the opening in the second portion being configured for receipt of the padlock, the padlock comprising a body and a shackle portion, the shackle portion having one end connected to the body and a second end removably connected to the body for moving between locked and unlocked positions, the padlock configured for connection to the angled bracket via insertion of the second end of the shackle portion through the opening in the second portion of the angled bracket and locking the second end of the shackle portion to the body in the locked position, the bushing configured for placement on the shackle portion, located substantially over the attachment fastener, and configured to limit slack of the padlock relative to the angled bracket with the second end of the shackle portion in its locked position, and wherein the bushing is configured to at least partially cover the attachment fastener attaching the first portion of the angled bracket to the horn such that access to and/or removal of at least the attachment fastener is substantially prevented.

16. The device according to claim 15, wherein the angled bracket is an L-shaped bracket, and wherein the first portion and the second portion comprise a substantially horizontal portion and a substantially vertical portion, respectively, that are relatively positioned in a substantially perpendicular configuration.

17. The device according to claim 15, wherein the attachment fastener is an anti-theft or tamper proof bolt.

18. The device according to claim 15, wherein another of the plurality of fasteners used for attachment of the base of the horn to the surface of the locomotive is different than the attachment fastener.

19. The device according to claim 15, wherein the padlock is positioned in a substantially parallel configuration or a substantially horizontal configuration relative to the surface of the locomotive when the padlock is connected to the angled bracket.

20. The device according to claim 15, wherein the bushing has a through hole for receipt of the shackle portion of the padlock therethrough.

* * * * *